United States Patent [19]

McComber

[11] 4,073,416

[45] Feb. 14, 1978

[54] CARRYING BELT FOR CB RADIOS AND SIMILAR DEVICES

[76] Inventor: Kenneth McComber, 2994 Foxwood, Bridgeton, Mo. 63042

[21] Appl. No.: 712,354

[22] Filed: Aug. 6, 1976

[51] Int. Cl.[2] ..... A45F 5/00

[52] U.S. Cl. ..... 224/5 H; 224/26 R; 224/54

[58] Field of Search ..... 224/5 R, 5 H, 5 A, 5 B, 224/5 V, 8 R, 13, 14, 19, 26 R, 26 B, 45 N, 45 M, 45 Q, 45 G, 49, 53, 55, 54, 58

[56] References Cited

U.S. PATENT DOCUMENTS

| | | | |
|---|---|---|---|
| 1,318,850 | 10/1919 | DeYong | 224/5 H X |
| 1,349,312 | 8/1920 | Barrett | 224/5 H X |
| 1,601,089 | 9/1926 | Tomlinson et al. | 224/5 R X |
| 2,304,367 | 12/1942 | Meyer et al. | 224/5 H |
| 3,172,586 | 3/1965 | Lu | 224/55 |
| 3,865,292 | 2/1975 | Foley | 224/58 X |
| 3,919,615 | 11/1975 | Niecke | 224/5 H X |

*Primary Examiner*—Albert J. Makay

[57] ABSTRACT

A carrying belt for CB radios and similar devices comprising a strap adapted to fit and secure about the waist of the user, a mounting harness mounted on the strap comprising an essentially flat pad provided with a plurality of mounting straps disposed at about the edge of the pad and a securing ring adapted to provide connection for the straps, a protective poncho and a microphone and battery pocket mounted on said strap and disposed proximate said rectangular pad.

3 Claims, 4 Drawing Figures

CARRYING BELT FOR CB RADIOS AND SIMILAR DEVICES

BACKGROUND OF THE INVENTION

With the advent of the current popularity of CB radios a need has arisen for a convenient carrying device for the radio. In particular, one form the CB unit takes is that of a rectangle approximately 5 inches by 8 inches and from an inch to 2 inches in thickness. In use the device is connected to battery power and antenna terminals by connecting leads extending from the CB unit. Along sides thereof are provided controls. Also extending from the unit is the hand held microphone. The size of the unit and its popularity has engendered a considerable theft problem and owners are carrying the units with them when leaving their automobiles. Also, a carrying device such as contemplated herein is desirable for motorcycle use.

SUMMARY OF THE INVENTION

In the present invention a device is contemplated which will allow the CB radio unit to be mounted on a belt which will carry the unit and allow the unit to be connected to a battery, which may be the vehicle battery or a battery carried in the belt, and also to an antenna while the radio is mounted still on the belt and with the belt on the user. The user may then use the radio while it is mounted on his belt or may remove the belt and use the radio in this fashion.

A further feature is that the harness is pivotally mounted which facilitates carrying and also positioning the radio to allow adjustment of its controls.

A primary object of the invention is to provide such a device constructed in a fashion which lends itself to simple and economical manufacturing and use.

Another object is to provide such a device which is readily usable in inclement weather.

A further object of the invention is to provide such a device which is readily usable by law enforcement officers and military personnel.

With the above primary and other incidental objects in view, which appear more fully in the specification of the invention which is provided herein, the invention to be protected by Letters Patent consists of the features of construction, the parts and combination thereof, and the mode of operation hereinafter described or illustrated in the accompanying drawings or their equivalents.

BRIEF DESCRIPTION OF THE DRAWINGS

Referring to the drawings wherein is illustrated a preferred but not necessarily only form of embodiment of the invention.

DETAILED DESCRIPTION OF THE INVENTION

Figure 1:
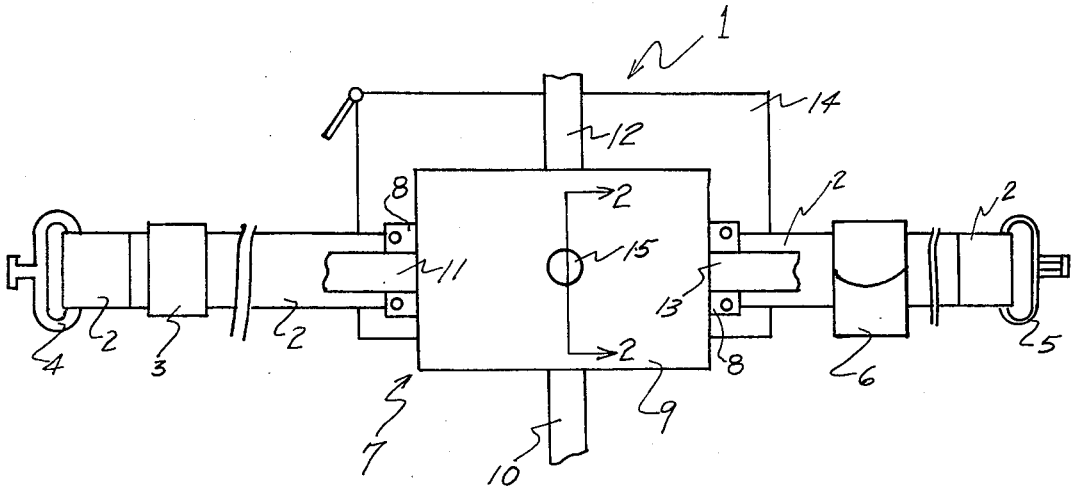
FIG. 1 is an elevation view of a belt constructed in accordance with and embodying the present invention.

Referring now to the drawings in more detail and in particular to FIG. 1, belt, 1, is shown to comprise belt portion, 2, adjusting means, 3, securing means, 4, and, 5, pocket, 6, adjustable harness, 7, belt stiffeners, 8, and poncho unit, 14. Adjustable harness, 7, comprises pad, 9. Straps, 10, 11, 12, and, 13, disposed at opposite edges thereof.

Figure 2:
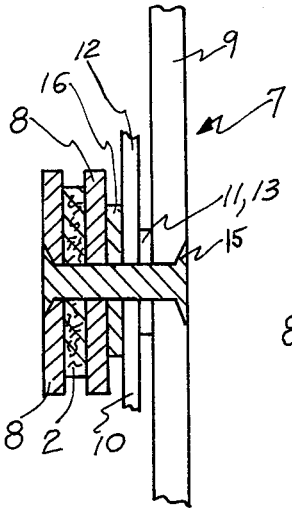
FIG. 2 is a sectional view of a portion of the device in FIG. 1.

In FIG. 2 the pivotal mounting of harness, 7, to belt, 2, is shown in greater detail. As shown, disposed on each side of belt, 2, are stiffeners, 8, which may or may not be necessary depending upon the materials used. In the embodiment shown straps, 10, and , 12, forms a single strap which crosses the single strap formed by straps, 11, and, 13, and the crossing area is disposed such that river 15 passes through the single straps. The crossing area is separated from the belt stiffener, 8, by washer, 16. It is readily apparent by mounting harness, 7, in this fashion that the entire harness, 7, may be pivoted about rivet, 15.

Figure 3:
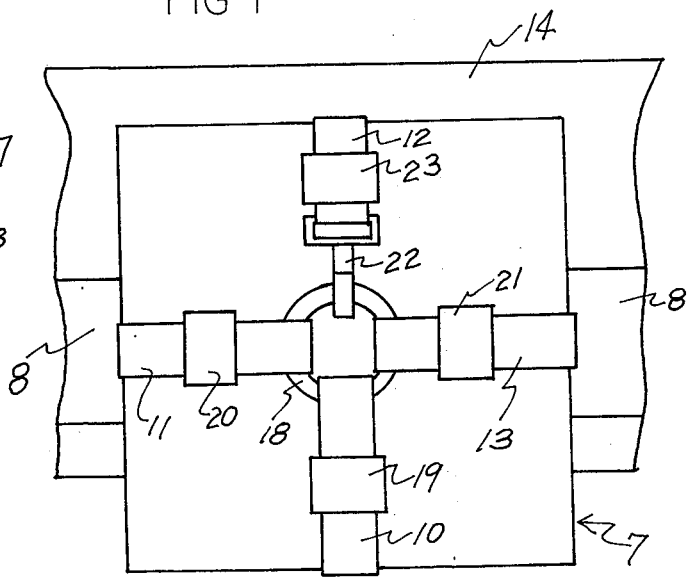
FIG. 3 is an elevation view of a CB radio installed on a portion of the device in FIG. 1.
Figure 4:
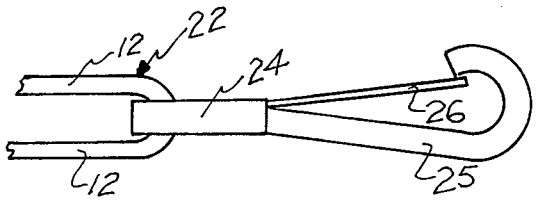
FIG. 4 is a side view of a snap used in the invention.

FIG. 3, illustrates how a CB unit is mounted on harness, 7. From FIG. 3 the balance of harness, 7, comprises straps, 10, 11, and, 13, looped over ring, 18, and secured in position by slidesnaps, 19, 20, and, 21, which may be of the type conventionally used with suspenders which allow adjustment of length and a locking means. Completion of the securing means of harness, 7, is accomplished by snap, 22, attached to strap, 12, which is also provided with slide snap, 23. Snap, 22, may be the conventional snaps used for leashes for animals and is shown in FIG. 4, to comprise strap portion, 24, rigid portion, 25, and flexible portion, 26. It should be apparent that in using this harness, 7, means are provided for quickly installing or removing unit, 17, or adjusting the harness for different size radios using slide-snaps, 19, 20, 21, and, 23.

An additional feature for inclement weather, such as a zipper, may be provided poncho unit, 14 for opening and closing the unit, 14. A suitably shaped poncho is secured therein and when the unit, 14, is opened a poncho drapes over the radio, 17. Pocket, 6, is provided proximate to harness to provide storage for a hand-mike and battery not shown.

It should be clear that harness, 7, may be configured in circular shape using three or more straps as may other shapes and straps be used.

While I have illustrated and described the preferred embodiments of my invention, it is to be understood that changes and modifications in the form, construction, arrangement and combination of the parts and steps of the Belt and methods of making and using the same may be substituted for those herein shown and described without departing from the nature and principle of my invention.

Having thus described my invention, what I claim as new and desire to secure by United States Letters Patent is:

1. A CB carrying belt comprising,
adjustable belt means,
securing means operably mounted on each end thereof,
pocket means mounted on said belt means,
harness means mounted on said belt means, said harness means comprising,
pivotal mounting means operably mounted on said belt means,
pad means operably mounted on said pivotal mounting means so as to allow pivoting of the pad in a plane parallel to said belt means,
a plurality of belt means operably attached to said pivotal mounting means, said point of attachment being disposed between said pad and said belt means, the free ends of said belt means being disposed about the edges of said pad means and secured to ring means disposed on the side of said pad means opposite to said belt means, one of said belt means being provided with snap means on its free end and said snap means connected to said ring means.

2. A CB carrying belt as described in claim 1 in combination with a pair of rigid belt stiffeners operably mounted on each side of said belt means and to which said harness means is attached.

3. A CB carrying belt as described in claim 2 in combination with pocket means operably mounted on the inner surface of said belt means, said pocket means provided with a closable opening in its upper surface and provided with a poncho secured to an inner surface of said pocket means.

* * * * *